US006967648B2

(12) United States Patent
Kim et al.

(10) Patent No.: US 6,967,648 B2
(45) Date of Patent: Nov. 22, 2005

(54) CIRCUIT AND METHOD FOR DRIVING SELF LIGHT-EMITTING DISPLAY DEVICE

(75) Inventors: Hak Su Kim, Seoul (KR); Yoon Heung Tak, Kyongsangbuk-do (KR); Minho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 423 days.

(21) Appl. No.: 10/207,205

(22) Filed: Jul. 30, 2002

(65) Prior Publication Data

US 2003/0025709 A1 Feb. 6, 2003

(30) Foreign Application Priority Data

Jul. 31, 2001 (KR) ..... 2001-46281

(51) Int. Cl.[7] ..... G09G 5/00
(52) U.S. Cl. ..... 345/207; 348/603
(58) Field of Search ..... 345/207; 348/602, 348/603

(56) References Cited

U.S. PATENT DOCUMENTS

| | | | | | |
|---|---|---|---|---|---|
| 5,926,318 | A | * | 7/1999 | Hebert | 359/618 |
| 6,052,118 | A | * | 4/2000 | Beeteson et al. | 345/207 |
| 6,310,609 | B1 | * | 10/2001 | Morgenthaler | 345/170 |
| 6,339,429 | B1 | * | 1/2002 | Schug | 345/589 |
| 6,396,217 | B1 | * | 5/2002 | Weindorf | 315/169.1 |
| 6,700,692 | B2 | * | 3/2004 | Tonar et al. | 359/265 |
| 6,762,741 | B2 | * | 7/2004 | Weindorf | 345/102 |

* cited by examiner

*Primary Examiner*—Ricardo Osorio
(74) *Attorney, Agent, or Firm*—Fleshner & Kim LLP

(57) ABSTRACT

Disclosed is a circuit for driving a self light-emitting display device which itself emits light when an electric or other energy is inputted thereto and a method thereof. According to the circuit and method, the self light-emitting display device can be driven more stably and with a higher efficiency by adjusting the number of used bits and luminance of respective color components in accordance with a luminance change of an external light and keeping a constant contrast ratio irrespective of the adjustment of the bit numbers.

11 Claims, 4 Drawing Sheets

CIRCUIT AND METHOD FOR DRIVING SELF LIGHT-EMITTING DISPLAY DEVICE

This application claims the benefit of the Korean Application No. P2001-46281 filed on Jul. 31, 2001, which is hereby incorporated by reference.

BACKGROUND OF THE INVENTION

1. Field of the Invention

The present invention relates to a light-emitting display device, and more particularly, to a circuit and method for driving a self light-emitting display device which itself emits light when an electric or other energy is inputted thereto.

2. Discussion of the Related Art

Generally, a light-emitting display device is classified into a passive light-emitting display device and an active light-emitting display device.

The typical passive light-emitting display device is a liquid crystal display (LCD). The passive light-emitting display device basically has a limited brightness against area, and has a problem in displaying a moving picture due to a relatively slow response speed. Also, the passive light-emitting display device has a limited angle of view.

The active light-emitting display device has been developed to overcome the drawbacks of the passive light-emitting display device.

The active light-emitting display device emits light for itself when the electric or other energy is inputted, and is known as a self light-emitting display device.

The self light-emitting display device may be a light-emitting diode (LED), cathode ray tube (CRT), plasma display panel (PDP), electroluminescence (EL), field emission display (FED), etc.

This self light-emitting display device has an excellent visual recognition in a place where an external light is not so bright, and has a simple circuit construction in comparison to the LCD.

For the above-described advantages, the spread of self light-emitting display device is gradually increasing.

However, according to the conventional technology, the contrast ratio of the self light-emitting display device is considerably lowered in a place where the external light is very bright. This causes the visual recognition to become deteriorated. In detail, in a place where the external light is quite bright, the visual recognition of the self light-emitting display device is considerably lowered in comparison to a reflective LCD that is an active light-emitting display device.

This problem limits the outdoor use of the display devices using the self light-emitting display devices.

In order to overcome the deterioration of the visual recognition of the conventional self light-emitting display devices, the power to be supplied to the devices should be heightened by increasing luminance of the panel of the light-emitting display device. That is, in order to keep an excellent visual recognition in an environment where a strong light is incident from the outside, the light-emitting display device should be turned on with a great brightness.

However, since the permissible applied voltage of the self light-emitting display device is limited in consideration of its efficiency and lifetime, it is not preferable to heighten the power by increasing the luminance without reason.

SUMMARY OF THE INVENTION

Accordingly, the present invention is directed to a circuit and method for driving a self light-emitting display device that substantially obviates one or more problems due to limitations and disadvantages of the related art.

An object of the present invention is to provide a circuit and method for driving a self light-emitting display device that can drive the self light-emitting display device more stably and with a higher efficiency by keeping a constant contrast ratio irrespective of a brightness change of an external light.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a circuit for driving a self light-emitting display device includes the self light-emitting display device, a detective sensor for sensing a grade of an external light, and a controller for controlling the number of used bits and/or luminance of respective color components of the self light-emitting display device with reference to sensed information provided from the detective sensor.

Preferably, if the luminance of light sensed by the detective sensor corresponds to an outdoor luminance level, the controller performs a control operation so that the number of bits of the color component having a good light-emitting efficiency among the color components of the light-emitting display device is reduced in a predetermined ratio or the luminance of the color component relatively increases, and the number of bits of the color component having a relatively bad light-emitting efficiency is reduced in a larger ratio than the color component having the good light-emitting efficiency or the luminance of the color component relatively decreases.

In another aspect of the present invention, a method for driving a self light-emitting display device includes a first step of sensing a grade of an external light, and a second step of controlling depths or luminance of respective color components in accordance with the sensed grade of the light.

Preferably, the second step controls the light-emitting display device so that the respective color components are turned on with different depths and/or luminance in accordance with the sensed external light.

Especially, the second step controls the light-emitting display device so that the respective color components are reduced in a larger ratio.

Preferably, the second step controls the light-emitting display device so that the number of used bits of the respective color components of the light-emitting display device is reduced and luminance of the respective color components increases in such a ratio that a whole contrast ratio is kept constant.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

In the present invention, the depth and/or luminance of color is actively adjusted according as the self light-emitting display device is driven indoors or outdoors.

For this, the same contrast ratio is kept both indoors and outdoors by reducing the number of color bits used for turning on the self light-emitting display device outdoors to be smaller than the number of color bits used for turning on the self light-emitting display device indoors and increasing luminance.

Figure 1:
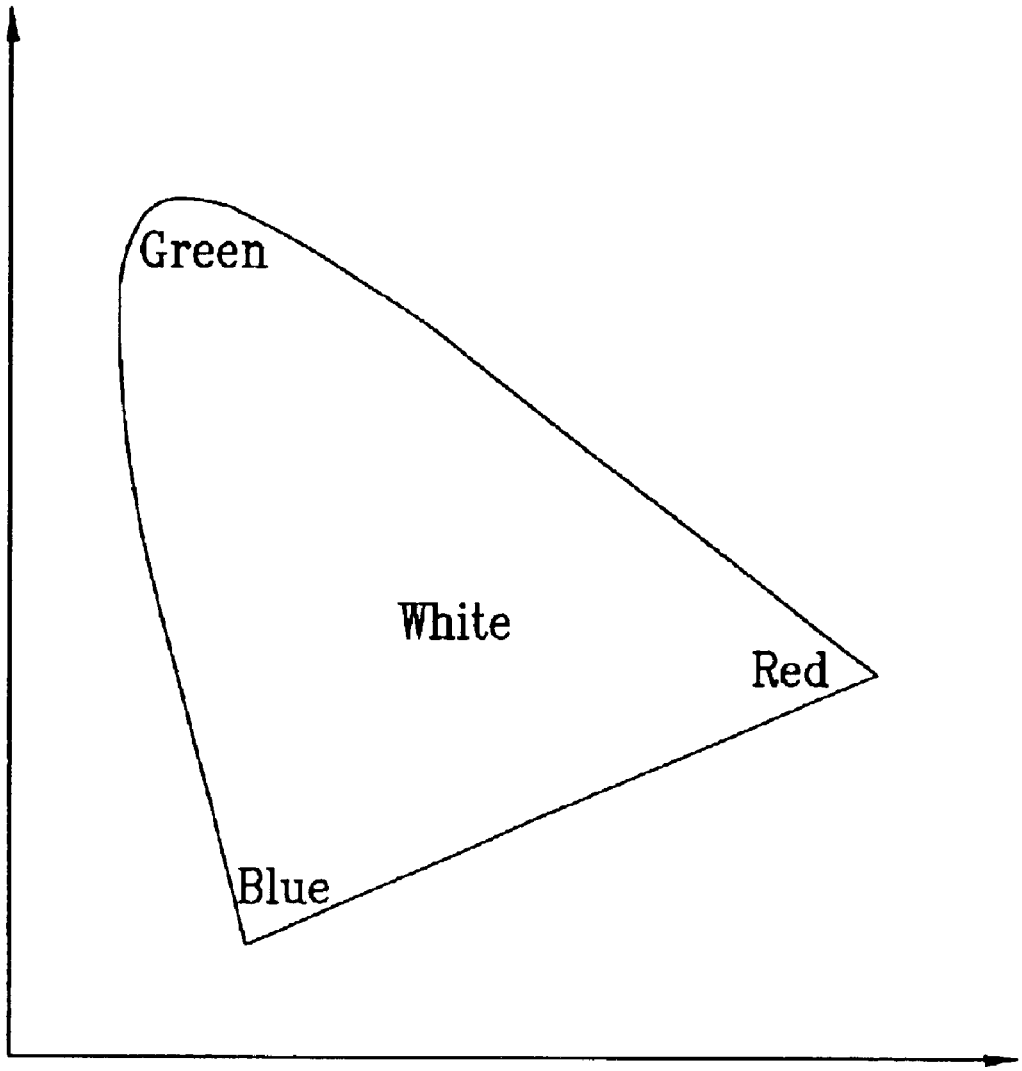
FIG.1 Related Art
FIG. 1 is a chromaticity diagram of a general CIE coordinate system representing a color range that can be displayed.

FIG. 1 is a chromaticity diagram of a general CIE coordinate system representing a color range that can be displayed.

The CIE (International Commission on Illumination) coordinate system is for representing color ranges of light-emitting display devices that can be displayed. That is, a general standard coordinate system used for the color display of the self light-emitting display devices is illustrated in FIG. 1.

In the CIE coordinate system, an area of a triangle defined by coordinate values of red (R), green (G) and blue (B) corresponds to the color range that can be displayed, and these coordinate values are obtained by measuring wavelengths of the three primary colors (i.e., RGB). Widening of the area of the triangle made by the coordinate values of the three primary colors in the coordinate system illustrated in FIG. 1 means widening of the color range that can be displayed.

The respective coordinate values of the three primary colors (RGB) in the CIE coordinate system are determined by the ratio of wavelengths of light reflected from a surface.

In the coordinate system, Y-axis represents a luminance value measured as an amount of light in all wavelengths, and X-axis represents a chromaticity value determined by hue and saturation.

That is, in the coordinate system, the measured values of the respective colors are expressed by hue, saturation and luminance.

Referring to FIG. 1, on a left lower part is the coordinate of blue, on a right lower part is the coordinate of red, and on a central upper part is the coordinate of green.

Figure 2:
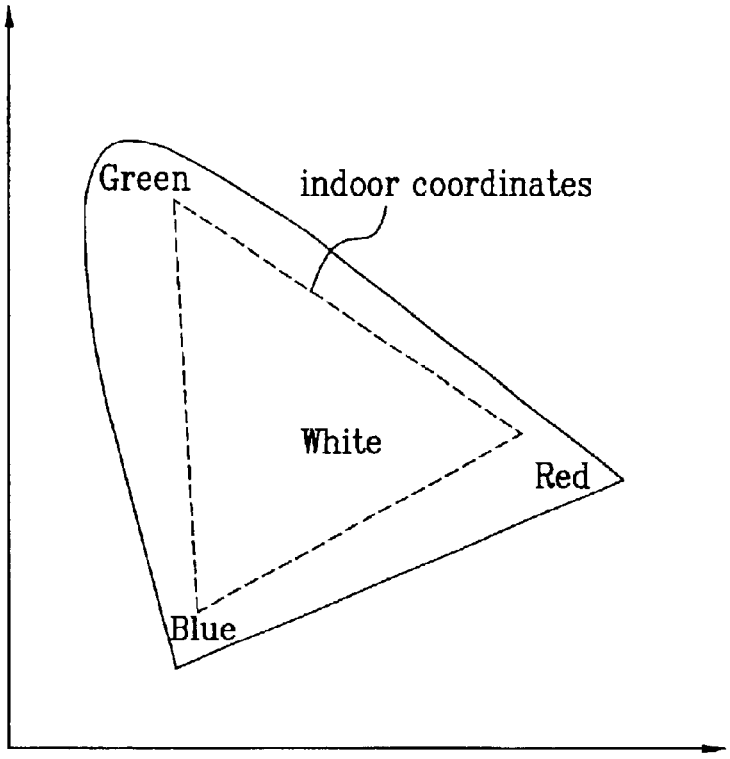
FIG.2 Related Art
FIG. 2 is a chromaticity diagram of a CIE coordinate system representing a general indoor color range.

FIG. 2 is a chromaticity diagram of a CIE coordinate system representing a general indoor color range.

FIG. 2 shows the color coordinate system in case of using an organic EL inside a room.

If it is assumed that 8 bits are used for the respective color, the contrast ratio is 1:500 when the luminance in a room is 100 nits, and the voltage at this time is 15V, the ratio of the respective colors is about R:G:B=3:6:1. The CIE coordinate system depicted by the EL is almost the same as that by a CRT.

However, in order to represent the indoor coordinate system outside the door, the following condition should be satisfied when 8 bits are used for the respective color.

Specifically, in order for the contrast ratio to be kept 1:500 outdoors, the luminance should be about 300 nits. In this case, the voltage should be boosted within the range of about 18V to 25V depending on efficiency of the respective colors. However, the problem is that the permissible applied voltage in consideration of the efficiency and lifetime of the self light-emitting display device is limited. That is, for the practical use of the light-emitting display device even outdoors, the applied voltage should not exceed 20V.

According to the present invention, the ratio of R, G and B is properly controlled in accordance with an external environment for the color display of the self light-emitting display device.

Figure 3:
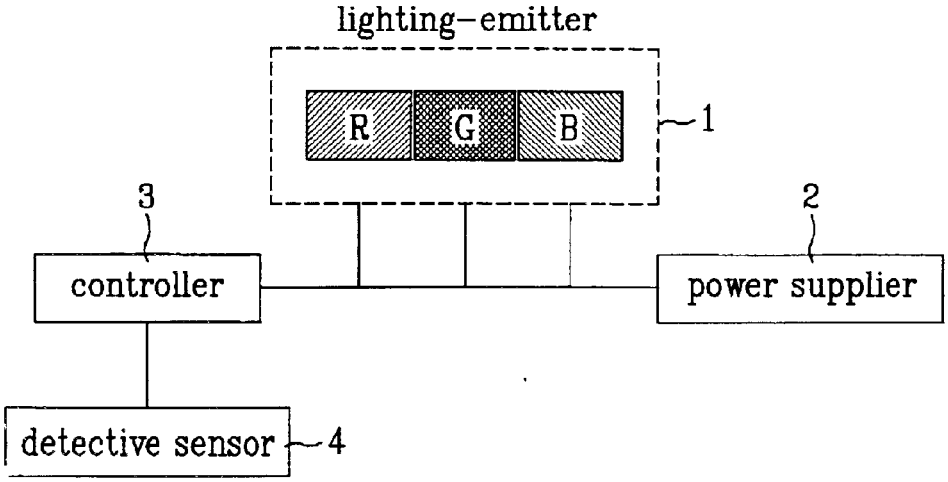
FIG. 3 is a block diagram of a circuit for driving a self light-emitting display device according to the present invention.

FIG. 3 is a block diagram of a circuit for driving a self light-emitting display device according to the present invention.

Referring to FIG. 3, the driving circuit according to the present invention includes a light emitter 1, a power supply 2 for supplying a power to the light emitter 1, a controller 3 for controlling the power supply 2 and the number of used bits of respective color components, and a detective sensor 4 for sensing a grade of an external light.

The light emitter 1 emits lights of the three primary colors. For instance, an organic EL has a structure wherein organic compounds that emit respective lights of red, green and blue are formed on a thin glass substrate, and a protective layer is formed on the organic compounds. Especially, the light emitter 1 according to the present invention uses the different numbers of bits and luminance in the outdoor or indoor with respect to the respective colors.

The light emitter 1 has electrodes provided on luminous materials for emitting the respective colors.

The power supply 2 supplies the power to the respective luminous materials. Especially, the power supply 2 applies a constant voltage to the respective electrodes.

At this time, the controller 3 controls the power supply 2 to keep a constant output voltage, and controls the numbers of used bits of the respective color components.

That is, the controller 3 adjusts the numbers of used bits of the respective color components of the light emitter 1 with reference to information sensed by the detective sensor 4.

The detective sensor 4 senses the grade of the external light, and provides the sensed information to the controller 3. For example, the detective sensor 4 measures and provides to the controller 3 the luminance of the outside.

The controller 3 adjusts the number of used bits and luminance of the respective color components of the light emitter 1 in accordance with the measured value of luminance provided from the detective sensor 4.

That is, the controller 3 reduces the number of used bits of the red component that is larger than the number of used bits of the green or blue component in accordance with the sensed external luminance.

The controller 3 performs a control operation so that the light emitter is turned on using the bit number of A (i.e., 4 bits) with respect to the red component among the respective color components and using the bit number of B (i.e., 6 bits) with respect to the green or blue component.

In the present invention, the role of the controller is to keep the contrast ratio always in a similar level by adjusting the bit numbers of the respective color components even if the grade of the external light is changed.

Figure 4:
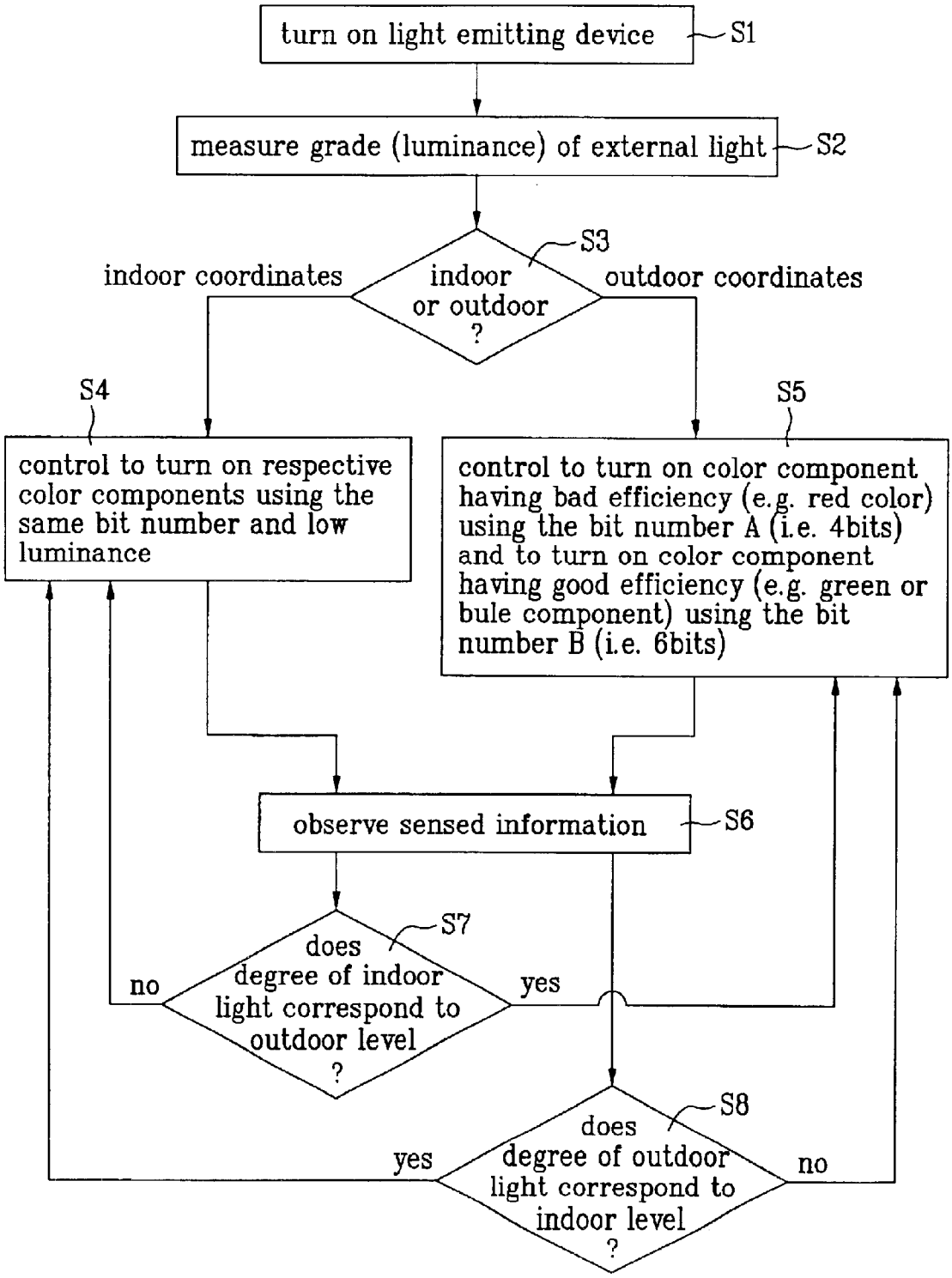
FIG. 4 is a flowchart illustrating a method for driving a self light-emitting display device according to the present invention.

FIG. 4 is a flowchart illustrating a method of driving a self light-emitting display device according to the present invention.

Referring to FIG. 4, if the light-emitting display device is turned on (step S1), the controller measures the grade of the external light (i.e., luminance) through the detective sensor (step S2).

Then, the controller judges whether the present environment where the light-emitting display device is turned on is the inside or outside of a room (step S3).

If the environment is the inside, the controller controls the light emitter to use the same number of bits (i.e., 8 bits) and dark luminance with respect to the respective color components (step S4).

On the contrary, if the environment is the outside, the controller performs a control operation so that the light emitter is turned on using the bit number of A (i.e., 4 bits) with respect to a color component having a bad efficiency (e.g., red component) among the respective color components along with luminance which increases in a relatively low ratio and using the bit number of B (i.e., 6 bits) with respect to a color component having a good efficiency (e.g., green or blue component) along with luminance which increases in a relatively high ratio (step S5).

Thereafter, the controller continuously observes the sensed information provided from the detective sensor (step S6).

If the sensed information that the light-emitting display device is turned on indoors and then its indoor environment is brightened to an outdoor level is provided (step S7), the controller performs a control operation so that the light emitter is turned on using the bit number of A (i.e., 4 bits) with respect to the color component having a bad efficiency (e.g., red component) among the respective color components along with luminance which increases in a relatively low ratio and using the bit number of B (i.e., 6 bits) with respect to the color component having a good efficiency (e.g., green or blue component) along with luminance which increases in a relatively high ratio (step S5).

Also, If the sensed information that the light-emitting display device is turned on outdoors and then its outdoor environment becomes dark to an indoor level is provided (step S8), the controller performs a control operation so that the light emitter is turned on using the same bit number (i.e., 8 bits) with respect to the respective color components and luminance is reduced (step S4).

In the control process of FIG. 4, when the controller controls to increase/decrease the number of used bits and luminance of the respective color component, its increase/decrease ratio is determined so that the whole contrast ratio is kept constant.

Figure 5:
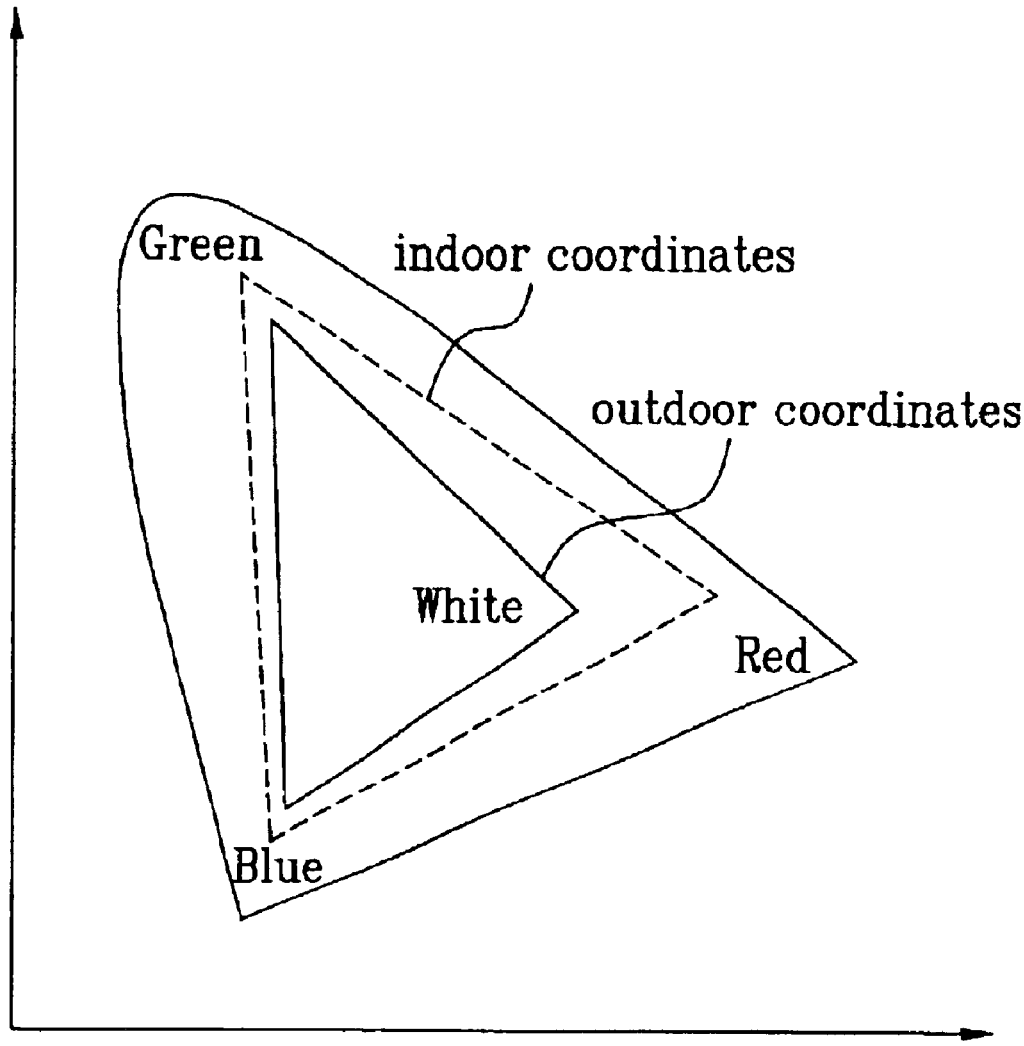
FIG. 5 is a chromaticity diagram of CIE coordinate systems representing indoor and outdoor color ranges realized according to the present invention.

In case of using the above control process, the indoor and outdoor CIE coordinate systems are compared with each other as shown in FIG. 5.

FIG. 5 is a chromaticity diagram of the CIE coordinate systems representing indoor and outdoor color ranges realized according to the present invention.

According to the present invention as described above, the display is performed using all the colors in case of driving the self light-emitting display device indoors, while the display is performed using a specified color having a good efficiency among all the colors in case of driving outdoors. Thus, a good contrast can be obtained outdoors without any great change of the quality of display, and it is not required to heighten the power supply.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A method of driving a self light-emitting display device comprising:

a first step of sensing a luminous intensity ambient light; and a second step of controlling the number of color bits of respective color components in accordance with the sensed luminous intensity, wherein the number of color bits of respective color components are controlled based on a light-emitting efficiency of the respective color components.

2. The method as claimed in claim 1, wherein the second step controls the light-emitting display device so that the respective color components are turned on with different color bits in accordance with the sensed luminous intensity.

3. The circuit as claimed in claim 1, wherein if the luminous intensity sensed by the detective sensor reaches a predetermined luminance level, the second step reduces the number of color bits of respective color components by a predetermined ratio, wherein the number of color bits of a third color component is reduced by larger ratio than a first color component and a second color component.

4. The circuit as claimed in claim 3, wherein the first color component is a green color component, the second color component is a blue color component, and the third color component is a red color component.

5. The method as claimed in claim 1, further comprising increasing the luminance of respective color components by a predetermined ratio if the luminous intensity sensed by the detective sensor reaches a predetermined luminance level, wherein a luminance of a third color component is increased by a lower ratio than a first color component and a second color component.

6. The method as claimed in claim 5, wherein the first color component is a green color component and a second color component among the color components.

7. A circuit for driving a self light-emitting display device comprising:

a detective sensor for sensing a luminous intensity of ambient light; and a controller for controlling the number of color bits of respective color components in accordance with the sensed luminous intensity, wherein the number of color bits of respective color components are controlled based on the light-emitting efficiency of the respective color components.

8. The circuit as claimed in claim 7, wherein if the luminous intensity sensed by the detective sensor reaches a predetermined luminance level, the controller performs a control operation so that the number of color bits of respective color components is reduced in a predetermined ratio, wherein the number of color bits of a third color component is reduced by a larger ratio than a first color component and a second color component.

9. The circuit as claimed in claim 8, wherein if the first color component is a green color component, the second color component is a blue color component, and the third color component is a red color component.

10. The circuit as claimed in claim 7, wherein if the luminous intensity sensed by the detective sensor reaches a predetermined luminance level, the controller performs a control operation so that luminance of respective color components is increased by a predetermined ratio, wherein a luminance of a third color component is increased by a lower ratio than a first color component and a second color component.

11. The circuit as claimed in claim 10, wherein the first color component is a green color component, the second color component is a blue color component, and the third color component is a red color component.

* * * * *